US006811215B2

(12) United States Patent
Horiki et al.

(10) Patent No.: US 6,811,215 B2
(45) Date of Patent: Nov. 2, 2004

(54) STRUCTURE FOR MOUNTING BACKREST

(75) Inventors: Toshiyuki Horiki, Nagano (JP); Nobuyuki Ueda, Osaka (JP)

(73) Assignees: Takano Co., Ltd., Nagano (JP); Kokuyo Co., Ltd., Osaka (JP)

( * ) Notice: Subject to any disclaimer, the term of this patent is extended or adjusted under 35 U.S.C. 154(b) by 0 days.

(21) Appl. No.: 10/442,102

(22) Filed: May 21, 2003

(65) Prior Publication Data

US 2004/0012237 A1 Jan. 22, 2004

(30) Foreign Application Priority Data

Jul. 17, 2002 (JP) ..... P2002-208316

(51) Int. Cl.[7] ..... A47C 7/46; A47C 31/00

(52) U.S. Cl. ..... 297/228.1; 297/218.4; 297/284.4

(58) Field of Search ..... 297/218.1, 218.4, 297/219.1, 226, 228.1, 228.13, 284.4

(56) References Cited

U.S. PATENT DOCUMENTS 4,065,182 A * 12/1977 Braniff et al. ..... 297/440.22
4,153,293 A * 5/1979 Sheldon ..... 297/284.4
5,318,346 A * 6/1994 Roossien et al. ..... 297/300.1
6,050,646 A * 4/2000 Stenzel et al. ..... 297/452.59
6,220,661 B1 * 4/2001 Peterson ..... 297/218.4
6,382,719 B1 * 5/2002 Heidmann et al. ..... 297/228.1
6,499,801 B1 * 12/2002 Peterson et al. ..... 297/228.13

FOREIGN PATENT DOCUMENTS

JP 07-095912 A 4/1995

* cited by examiner

*Primary Examiner*—Peter R. Brown
(74) *Attorney, Agent, or Firm*—Banner & Witcoff LTD

(57) ABSTRACT

In a chair 11 comprising at least a backrest portion 1 to support a back of a seated person and a back frame 2 to connect the backrest portion 1 with a seat, the backrest portion 1 has a pocket 3 that covers an upper portion of the back frame 2, the pocket 3 has an engaging portion 4 that prevents the upper portion from being pulled out of the pocket 3 by making an engagement with the upper portion of the back frame 2 and the upper portion of the back frame 2 is covered with the pocket 3 and the backrest portion 1 is mounted on the back frame 2 by engaging the engaging portion 4 with the covered upper portion of the back frame 2.

4 Claims, 12 Drawing Sheets

STRUCTURE FOR MOUNTING BACKREST

CROSS REFERENCE TO RELATED APPLICATIONS:

This application is based upon and claims the benefit of priority from the prior Japan Patent Application No. P2002-208316, filed Jul. 17, 2002, the entire contents of which are incorporated herein by reference.

BACKGROUND OF THE INVENTION AND RELATED ART STATEMENT

This invention relates to a structure for mounting a backrest. More specifically, the present claimed invention relates to a structure for mounting a backrest on a back frame.

A conventional structure for mounting a backrest comprises, as shown in FIG. 15, a backrest portion 101 that has a nature of cushion, an inner shell 102 as a shell of the backrest portion 101, a back support rod 104 that is mounted on the inner shell 102 with a screw 103 so as to connect the backrest portion 101 with a seat and an outer shell 105 that is mounted on a back face side of the backrest portion 101 so as to cover a connecting portion of the inner shell 102 and the back support rod 104. (Refer to FIG. 4 of Japan Laid Open No. 07-095912.)

However, since the conventional structure for mounting the backrest uses the outer shell 105, there are some problems such that a number of components is increased or a process of assembling is also increased. In addition, since the structure uses a lot of screws 103 for mounting the backrest, a process of mounting or dismounting the backrest is troublesome.

The present claimed invention intends to provide a structure that uses neither an outer shell nor or few screws so that the backrest portion can be mounted on the back frame with ease.

SUMMARY OF THE INVENTION

In order to attain the above object, a structure for mounting a backrest described in claim 1 is, in a chair comprising at least a backrest portion to support a back of a seated person and a back frame to connect the backrest portion with a seat, so arranged that the backrest portion has a pocket that covers an upper portion of the back frame, the pocket has an engaging portion that prevents the upper portion from being pulled out of the pocket by making an engagement with the upper portion of the back frame and the upper portion of the back frame is covered with the pocket and the backrest portion is mounted on the back frame by engaging the engaging portion with the covered upper portion of the back frame.

As a result, the backrest portion is mounted on the back frame by covering the upper portion of the back frame with the pocket provided on the backrest portion and engaging the engaging portion provided on the pocket with the covered upper portion of the back frame. This makes it possible to mount the backrest portion on the back frame easily without an outer shell and with a few or no screw.

Further, the structure for mounting the backrest described in claim 2 of the structure described in claim 1 is so arranged that the backrest portion comprises a frame-shaped inner shell and a bag-shaped superficial skin that wraps the inner shell and the upper portion of the back frame has a frame body comprising a portion facing to the inner shell and a portion that makes an engagement with the engaging portion. In this case, the backrest portion can be supported in a stable condition by overlapping the inner shell and the frame body of the back frame.

Further, the structure for mounting the backrest described in claim 3 of the structure described in claim 1 or 2 is so arranged that the engaging portion is arranged at an opening edge portion of the pocket. In this case, the pocket is prevented from being rolled and from being unstrained or wrinkling.

Further, the structure for mounting the backrest described in claim 4 of the structure described in one of claim 1 through claim 3 is so arranged that the backrest portion has a bent portion that is formed to protrude toward a lumbar of the seated person, the back frame has a movable member that is so arranged to move relatively to the back frame, a lower end side of the backrest portion is mounted on the movable member and a protruding amount of the bent portion can be adjusted by moving the movable member. In this case, a lumbar support mechanism that can adjust a protruding amount of the bent portion that is formed to protrude toward the lumbar of the seated person can be constructed.

DETAILED DESCRIPTION OF THE PREFERRED EMBODIMENTS

Figure 1:
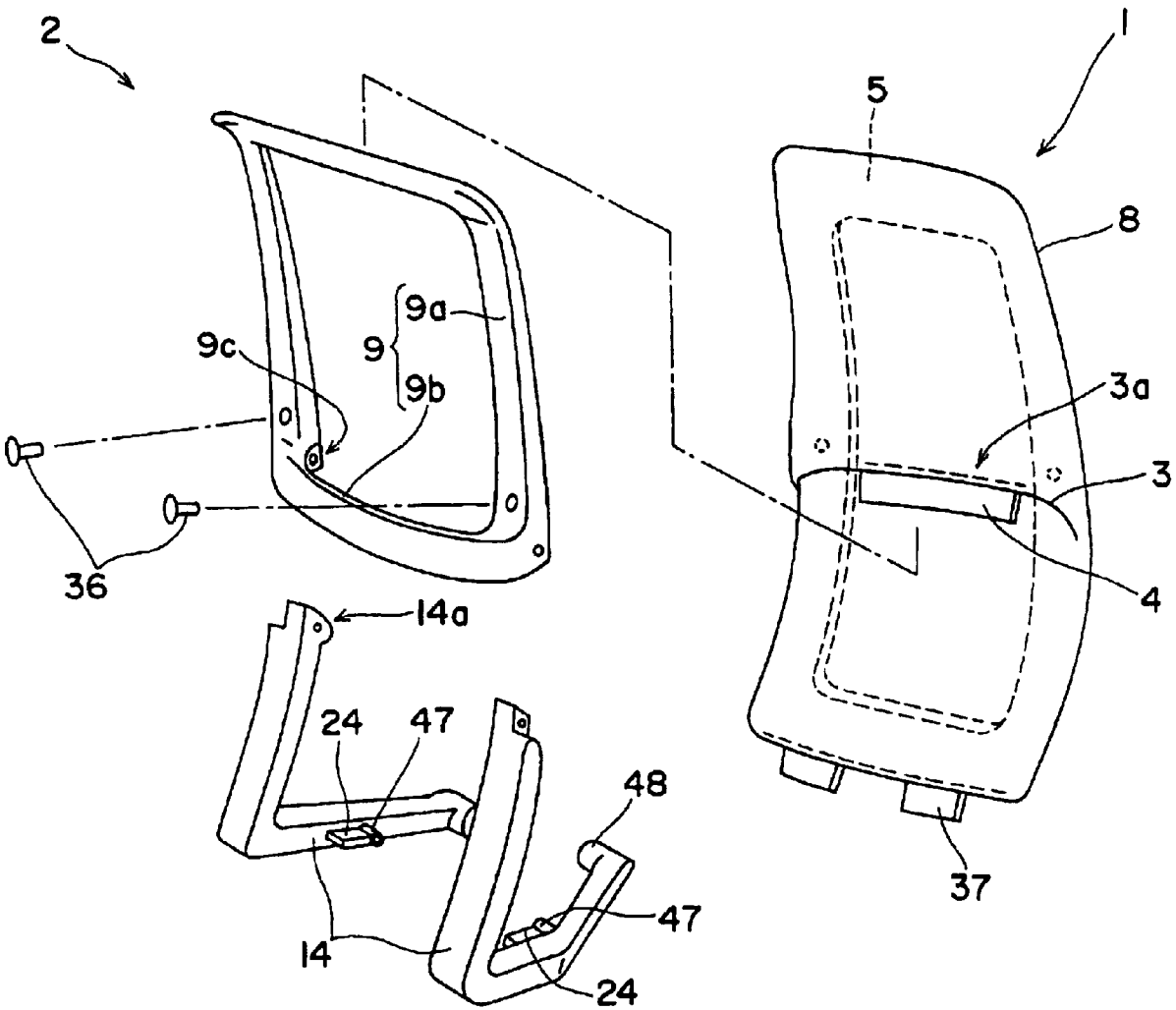
FIG. 1 is a general perspective view showing a structure for mounting a backrest in accordance with one embodiment of the present claimed invention.

An arrangement of the present claimed invention will be described in detail with reference to the accompanying drawings.

An embodiment of the structure for mounting the backrest in accordance with the present claimed invention is shown in FIG. 1 through FIG. 7. The structure for mounting a backrest is, in a chair 11 comprising at least a backrest portion 1 to support a back of a seated person and a back frame 2 to connect the backrest portion 1 with a seat 15, so arranged that the backrest portion 1 has a pocket 3 that covers an upper portion of the back frame 2, the pocket 3 has an engaging portion 4 that prevents the upper portion from being pulled out of the pocket 3 by making an engagement with the upper portion of the back frame 2 and the upper portion of the back frame 2 is covered with the pocket 3 and the backrest portion 1 is mounted on the back frame 2 by engaging the engaging portion 4 with the covered upper portion of the back frame 2.

The backrest portion 1 of this embodiment comprises, for example, an inner shell 5 and a bag-shaped superficial skin 8 that wraps the inner shell 5. In accordance with the arrangement, it is possible to obtain the backrest portion 1 high in cushioning, thin and compact. This embodiment is just only a preferable example, and an arrangement of the backrest portion 1 is not limited to this embodiment.

The inner shell 5 is formed to be, for example, frame-shaped. More specifically, the inner shell 5 of this embodiment is formed to be rectangular in a front view and curved to bulge a little toward a lumbar of a seated person in a side view. The frame-shaped inner shell 5 makes it possible to support a back of the seated person with the superficial skin 8 alone so as to obtain high cushioning, thereby to improve feeling to sit on. A shape of the inner shell 5 is not limited to this and may be various shapes as far as it can form a face expected as a backrest. For example, a rectangular is general, but may be curved or other shapes from an aesthetic view point or an ergonomic view point and may not necessarily be a closed frame. It is preferable that the inner shell 5 is provided with both rigidity that can keep the shape as the backrest 1 and flexibility that allows the inner shell 5 to transform to a certain degree so that the inner shell 5 can easily be mounted on the back frame 2. A material or a thickness of the inner shell 5 can be selected so as to have both the above rigidity and the above flexibility. The material of the inner shell 5 is preferably a synthetic resin having both appropriate rigidity and flexibility. However, the material of the inner shell 5 is not limited to a synthetic resin, and may be any material as far as it has both required rigidity and flexibility.

The superficial skin 8 is of, for example, a material that can produce an appropriate elasticity and tensility and formed to be a bag shape having an opening at a lower end side of the backrest. The superficial skin 8 is formed to be a little smaller than the inner shell 5 and serves as an elastic element for supporting the backrest by wrapping the inner shell 5 and serves as an upholstery fabric constituting a face of a backrest. A material of the superficial skin 8 may be a material that can produce an appropriate elasticity and tensility, a film (for example, a resin film such as polyester elastomer, polyurethane elastomer or the like, or a resin film reinforced with a fiber such as polyamide or a fabric such as taffeta), a fabric, a non-woven cloth. Especially, a mesh sheet made of polyester that is small in wear-out and high in elasticity or permeability is preferable. After the inner shell 5 is accommodated, it is preferable that the opening portion of the superficial skin 8 is closed with a tacker or sewing to prevent the inner shell 5 from being pulled out.

The pocket 3 in this embodiment is made of material that can produce an appropriate elasticity and tensility (the same material as that of the superficial skin 8 in this embodiment) and arranged on the superficial skin 8 with sewing. A size of the pocket 3 is not necessarily limited, but preferably large enough to occupy generally an upper half of the back face (namely, a face on which the back frame 2 is mounted) of the backrest portion 1 from a view point of stability in mounting on the back frame 2. An opening of the pocket 3 is formed to be horizontal at a generally middle potion in a back face side of the backrest portion 1. In this embodiment the pocket 3 is formed to have another bag on the bag-shaped superficial skin 8 with which the inner shell 5 is covered, but is not necessarily limited to this shape. For example, generally middle portion of a back face side of the superficial skin 8 with which the inner shell 5 is covered may be cut horizontally so as to form a pocket 3.

Figure 8:
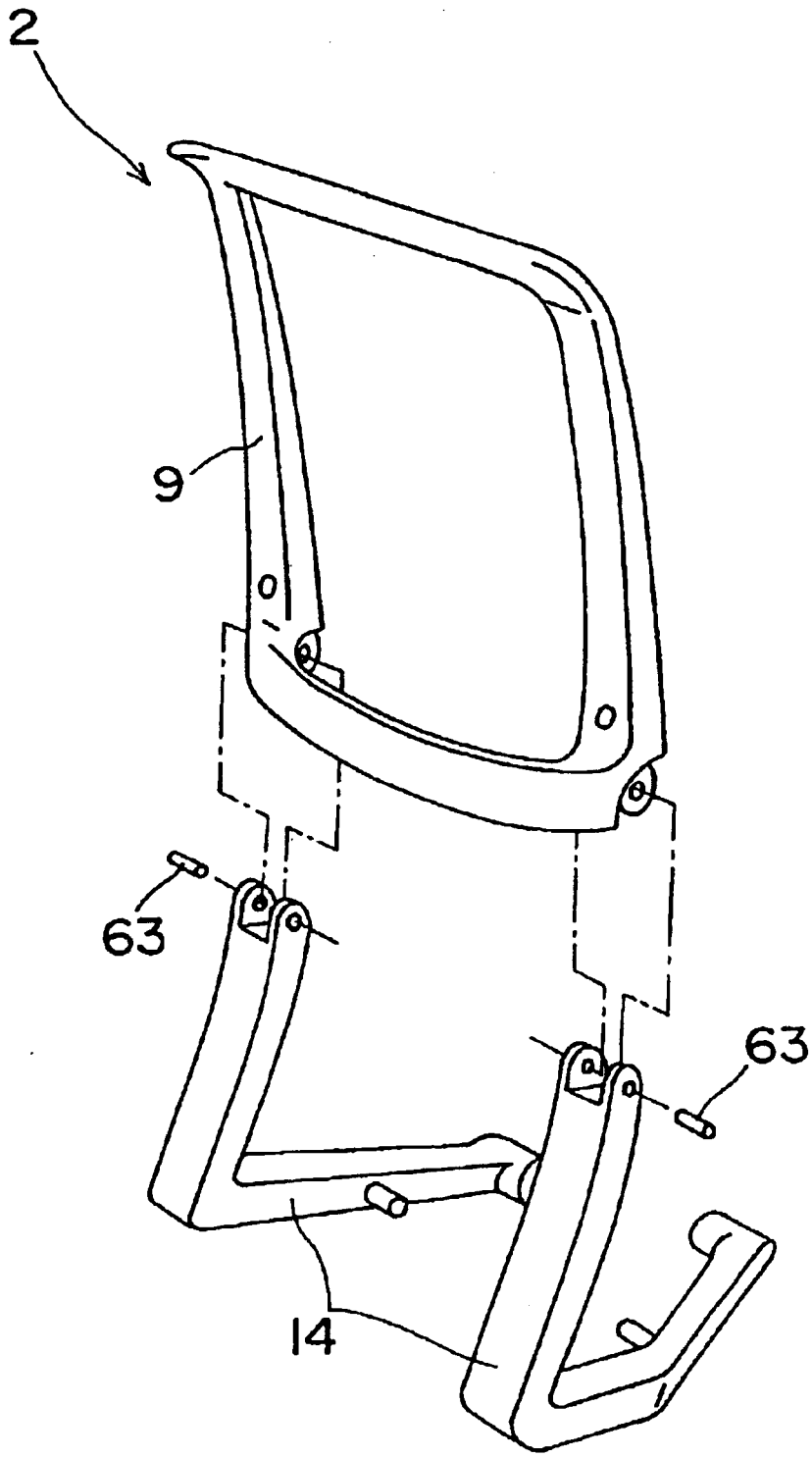
FIG. 8 is a general perspective view showing another example of a structure of the back frame.

The upper portion of the back frame 3 that is covered with the pocket 3 comprises a portion facing to the inner shell 5 and a portion engaging with the engaging portion 4. The portion facing to the inner shell 5 serves as a stable support of the backrest portion 1 and the portion engaging with the engaging portion 4 serves as a check to prevent the upper portion of the back frame 2 from being pulled out of the pocket 3. More specifically, the back frame 2 in this embodiment comprises a frame body 9 covered with the pocket 3 and a lower frame 14 supporting the frame body 9. The frame body 9 comprises a channel shaped portion 9*a* facing to the generally upper half of the inner shell 5 and a cross beam 9*b* locating near the opening of the pocket 3. It is preferable that the back frame 2 has such a high rigidity that it can support the highly flexible backrest portion 1 in a stable manner. Then the frame body 9 in this embodiment is made of synthetic resin (for example, synthetic resin of nylon system) that is harder than the inner shell 5 and the channel shaped portion 9*a* and cross beam 9*b* are integrally formed. The lower frame 14 is made of a metal (for example, aluminum alloy or a zinc die cast metal that is light and superior in rigidity). Connecting portions 9*c*, 14*a* of the frame body 9 and the lower frame 14 are formed to fit each other. The frame body 9 and the lower frame 14 are fixed as a unit by fitting the frame body 9 and the lower frame 14 each other and then fixing them with a screw. The arrangement of the back frame 2 is not limited to this embodiment. For example, as shown in FIG. 8, the frame body 9 may be mounted on the lower frame 14 in a rotatable manner around a pin 63. The frame body 9 and the lower frame 14 may be integrally formed with a resin, a metal material or the like.

Figure 2:
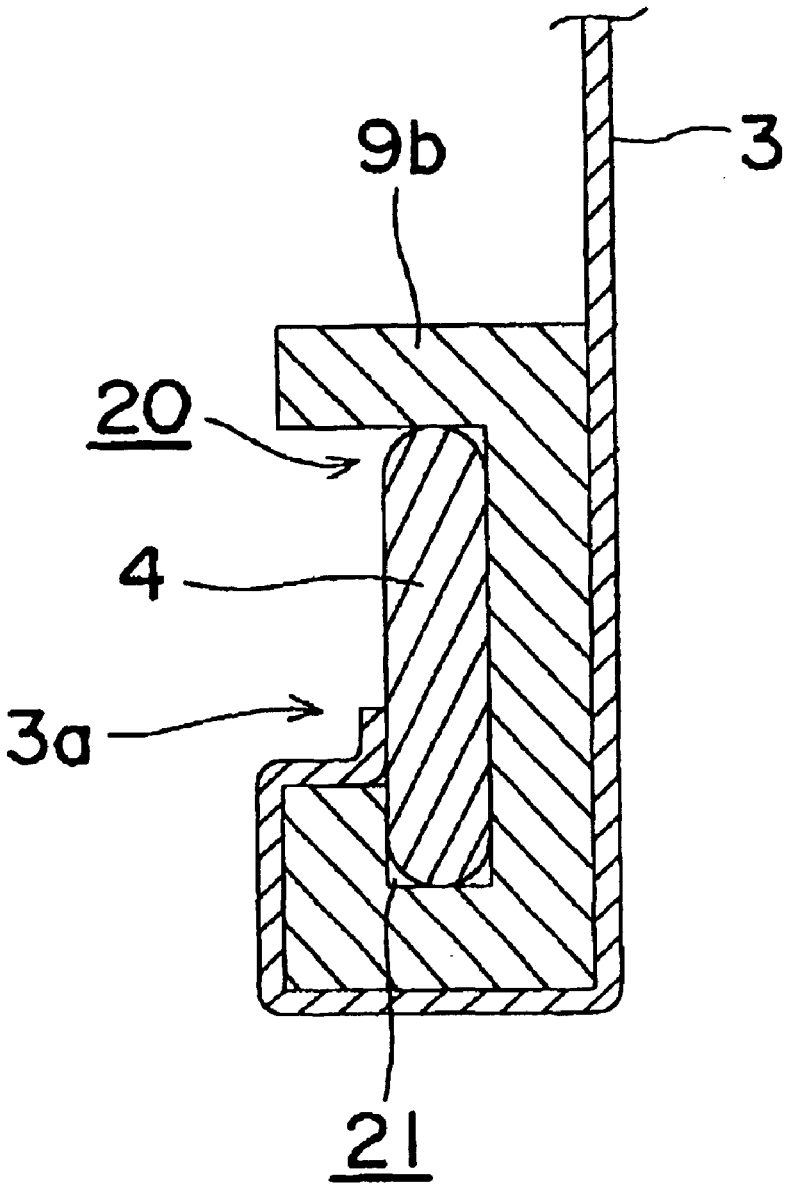
FIG. 2 is a general center cross-sectional side view showing an embodiment of an engaging state of an engaging portion of the structure for mounting the backrest.

The pocket 3 in this embodiment is provided with an engaging plate 4 as an engaging portion. The engaging plate 4 is made of, for example, resin and mounted on an inner side of an opening edge portion 3*a* of the pocket 3 with sewing so as to make an engagement with the cross beam 9*b* of the back frame 2. The cross beam 9*b* in this embodiment is so formed that the engaging plate 4 is fitted into the pocket 3 with giving tension to the pocket 3 in a side of the seated person and the engaging plate 4 that is fitted into the pocket 3 is prevented from being pulled out of the pocket 3 by making use of tension of the pocket 3. More specifically, the cross beam 9*b* of this embodiment comprises, as shown in FIG. 2, space 20 into which the engaging plate 4 is fitted and a groove 21 that prevents the engaging plate 4 from being out of the pocket 3 by making use of tension of the pocket 3.

The lower end portion of the backrest portion 1 in this embodiment is mounted on, for example, a lumbar support mechanism. The lumbar support mechanism can adjust a protruding amount of a bent portion 1*a* formed on the backrest portion 1 so as to protrude toward a lumbar of the seated person. The lumbar support mechanism in this embodiment comprises a fixed plate 22 that is fixed to the lower frames 14, 14 so as to bridge a pair of the lower frames 14, 14 and a movable member 23 that is mounted on the fixed plate 22 and that can move upward and downward of the backrest portion 1. The lower end portion of the backrest portion 1 in this embodiment is mounted on the movable member 23. On the movable member 23 formed is, for example, a groove 35 into which the lower end portion of the backrest portion 1 is inserted.

The fixed plate 22 is formed to be in a shape of a general box opening downward (a side to be grounded) and is fixed to a mounting portion 24 integrally formed with the lower frame 14, for example, with a screw. The movable member 23 comprises a portion 23*a* accommodated in a space between a pair of the lower frames 14, 14 and a projecting portion 23*b* making an engagement with a pair of the lower frames 14, 14 and also a slider 26 guided by a guiding shaft 25 arranged in an lower face side of the fixed plate 22 is integrally provided. The movable member 23 is so arranged that it can travel between a position where the projecting portion 23*b* makes an engagement with the lower frame 14 and a position where the slider 26 makes an engagement with the fixed plate 22.

A pair of brackets 27, 27 are formed in the lower face side of the fixed plate 22 and a lever 28 is mounted on the bracket 27 in such a manner that the lever 28 can swing. One end of the lever 28 is mounted on the movable member 23 and the lever 28 is so arranged that the movable member 23 travels with guided by the guiding shaft 25 when the lever 28 swings. More specifically, the lever 28 comprises a supporting shaft 29 that functions as a supporting point, a pin 30 that functions as a power point and a long hole 32 that functions as an action point. The pin 30 is inserted into the groove 31 formed on the movable member 23. The supporting shaft 29 is mounted on the bracket 27 in a rotatable manner. A crank portion 33*a* of a crankshaft 33 penetrates the long hole 32. The lever 28 comprises a member 28*a* on which the pin 30 and the supporting shaft 29 is formed and a member 28*b* on which the long hole 32 is formed so as to be integrally formed to be generally in a shape of a "V" character. The member 28*b* on which the long hole 32 is formed to be narrower than the member 28*a* in width so as not to disturb rotation of the crank portion 33*a*. The rotational axis 33*b* of the crankshaft 33 is mounted on the bracket 27 in a rotatable manner around an axis parallel to the supporting shaft 29. The crank portion 33*a* is so arranged to rotate around the rotational axis 33*b* of the crankshaft 33 between a pair of the brackets 27, 27.

Figure 3:
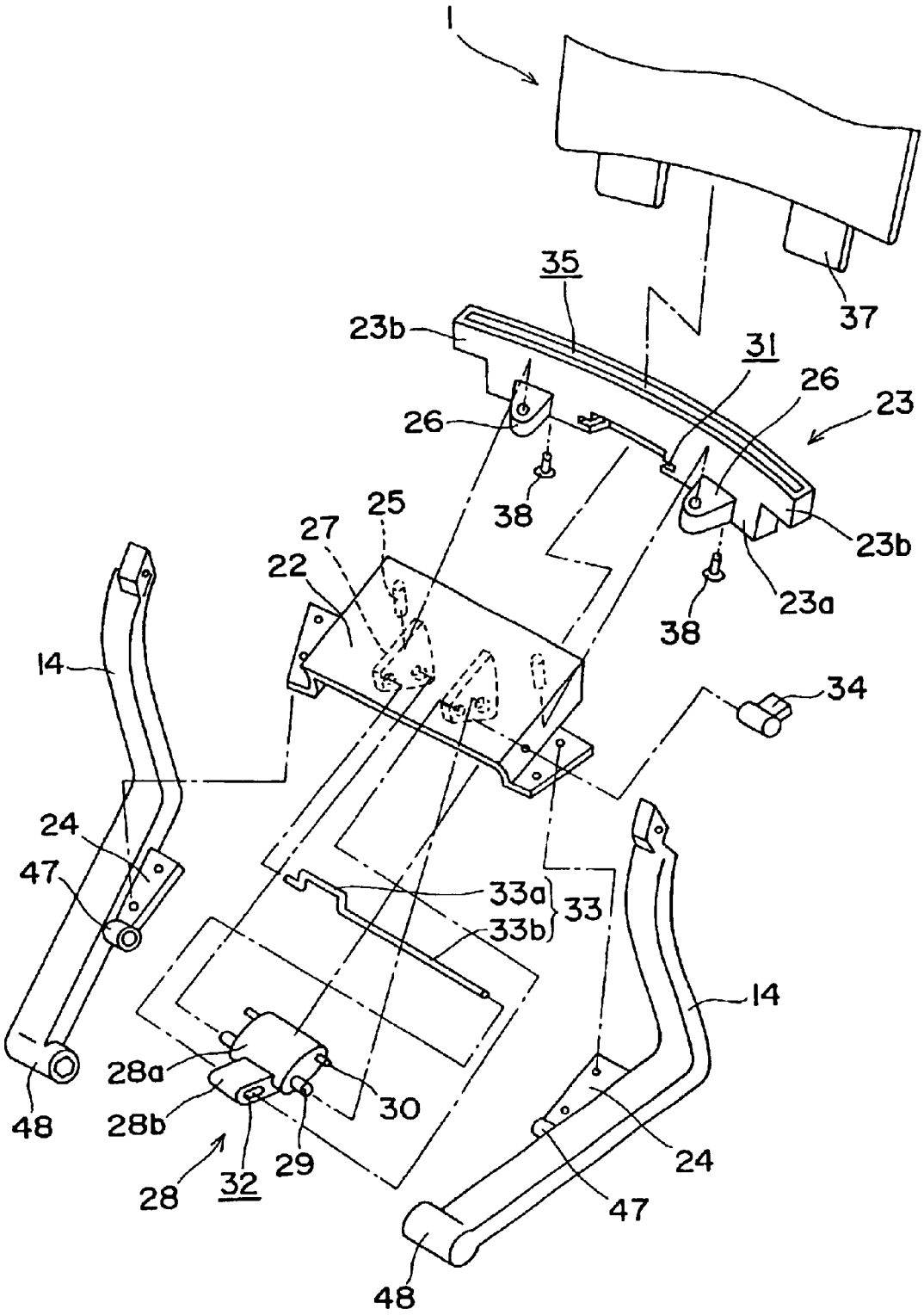
FIG. 3 is an exploded general perspective view showing an example of an arrangement of a lumbar support mechanism with which a chair to which the above structure for mounting the backrest is applied is equipped.
Figure 4:
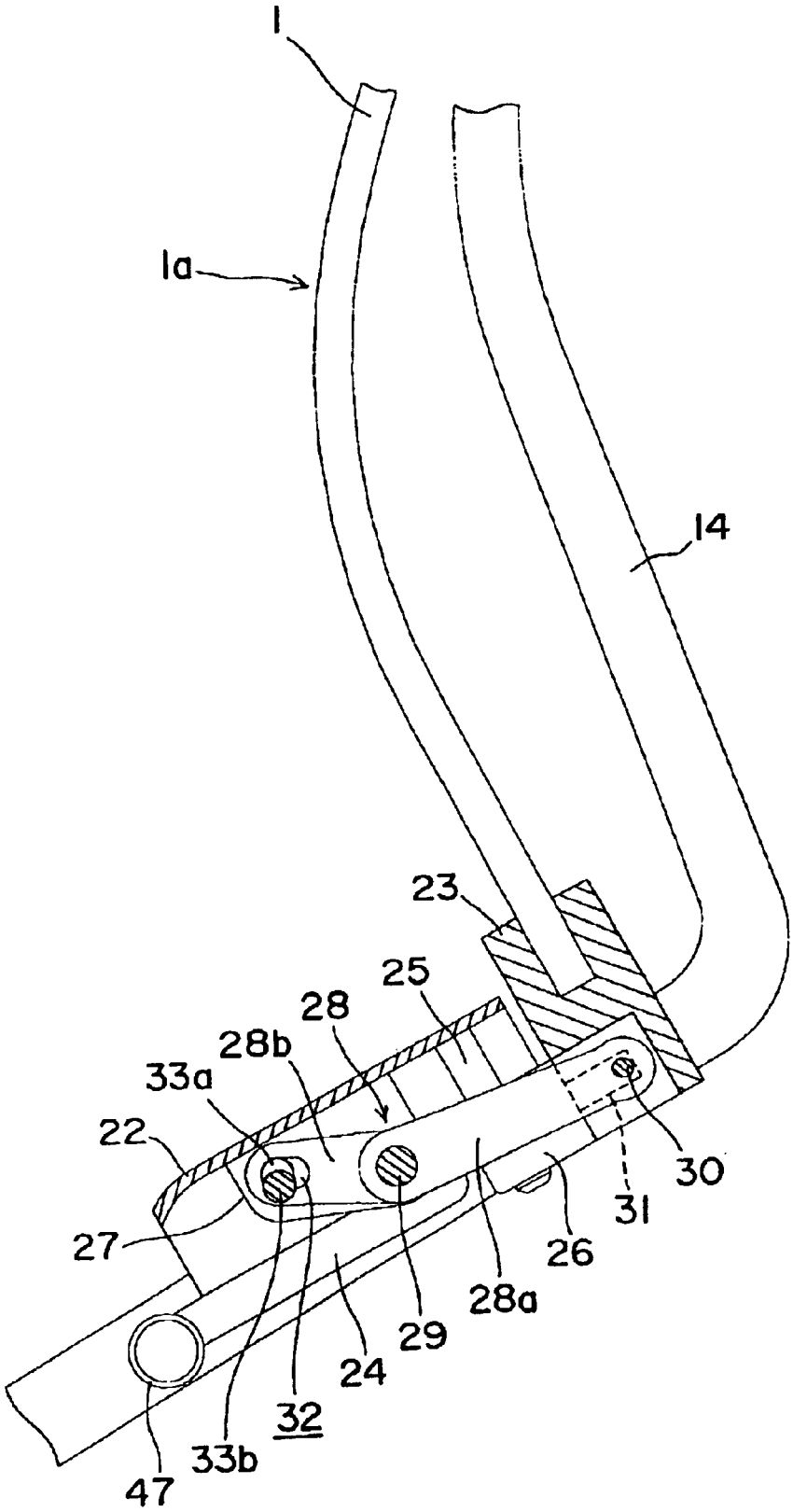
FIG. 4 is a general cross-sectional side view showing an example of a movement of the above lumbar support mechanism.
Figure 5:
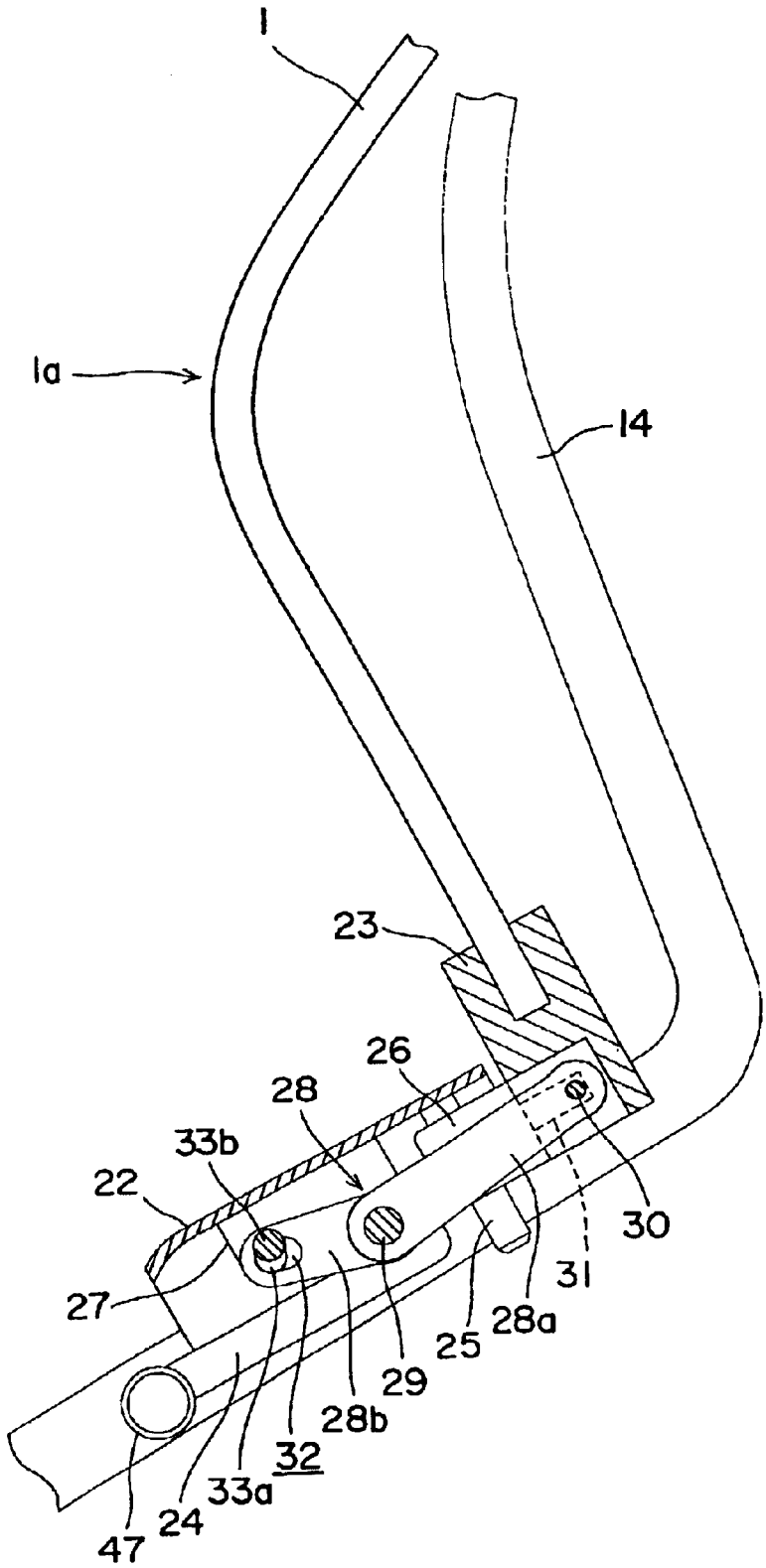
FIG. 5 is a general cross-sectional side view showing another example of a movement of the above lumbar support mechanism.

As a result of this, when the crankshaft 33 is rotated clockwise or counterclockwise, the crank portion 33*a* rotates around the rotational axis 33*b* with traveling in the long hole 32, accompanied by that the lever 28 swings around the supporting shaft 29 and then the movable member 23 is pushed upward so as to approach the bent portion 1*a* of the backrest portion 1 or pushed downward so as to move away from the bent portion 1*a* through the pin 30. When the movable member 23 that supports the lower end portion of the backrest portion 1 approaches the bent portion 1*a* of the backrest portion 1, a protruding amount of the bent portion 1*a* toward the lumbar of the seated person increases. (See FIG. 5) On the other hand, when the movable member 23 moves away from the bent portion 1*a*, a protruding amount of the bent portion 1*a* toward the lumbar of the seated person decreases. (See FIG. 4) Each of FIG. 4 and FIG. 5 is a cross-sectional side view showing an inner state of the bracket 27. The code 34 in FIG. 3 is an operational member that is mounted on the crankshaft 33 in an integrally rotatable manner. The operational member 34 may be omitted and the crankshaft 33 may be rotated by making use of a tool like a driver.

Figure 6:
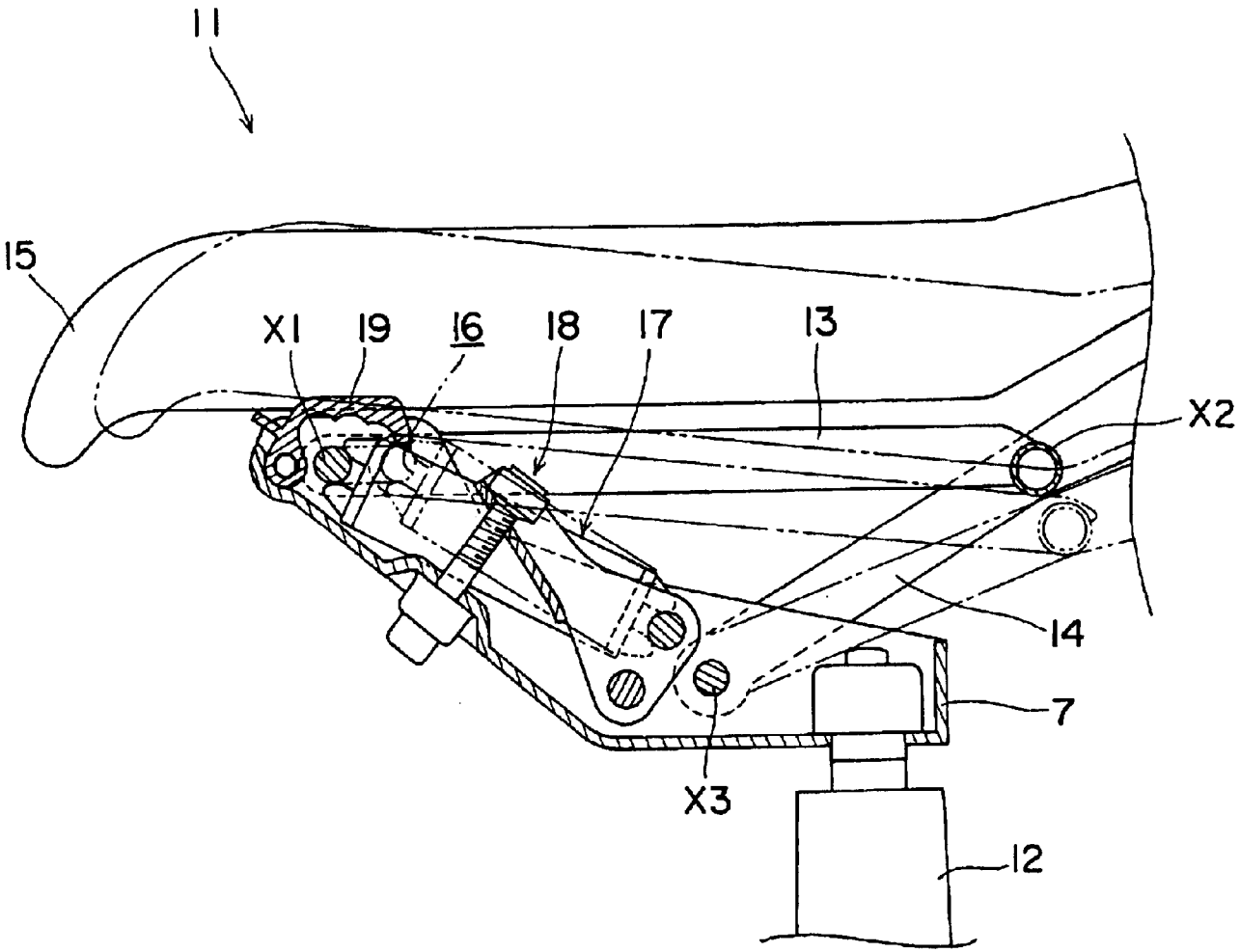
FIG. 6 is a general center cross-sectional side view showing a part around a seat frame of a chair to which the structure for mounting the backrest is applied.
Figure 7:
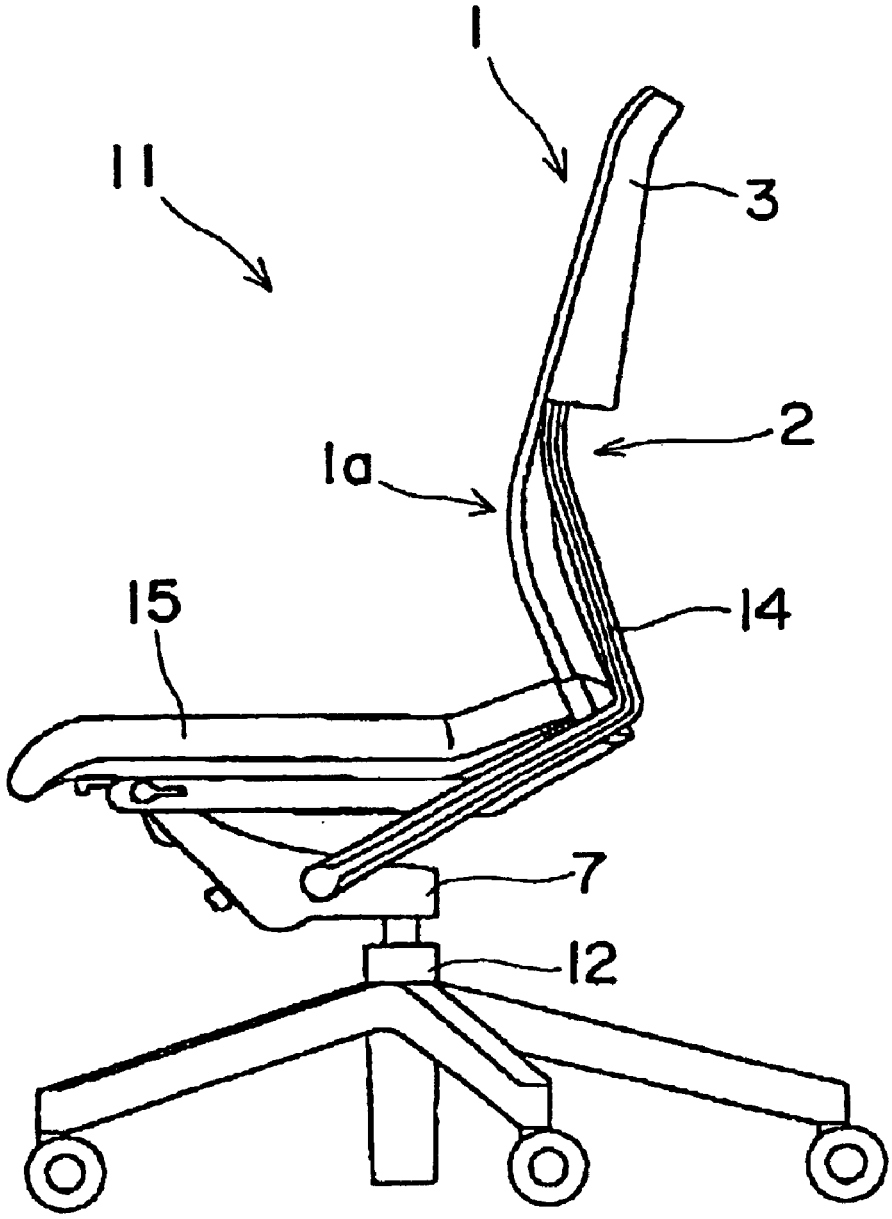
FIG. 7 is a general side view of a chair to which the above structure for mounting the backrest is applied.

In the chair 11 in accordance with the embodiment the seat and the backrest are so arranged to make a rocking movement. However, a chair to which the present claimed invention is applied is not limited to a rocking chair. For example, the chair 11 in accordance with the embodiment comprises, as shown in FIG. 6 and FIG. 7, a leg 12, a supporting body 7 mounted on an upper end side of the leg 12, a seat frame 13 whose front portion is supported by the supporting body 7 through an axis X1 and a lower frame 14 whose proximal end side is mounted on the supporting body 7 through an axis X3 and whose middle portion is connected to a rear portion of the seat frame 13 through an axis X2. The lower frame 14 is generally in a shape of a character "L" having a generally horizontal portion and a generally vertical portion. The axis X3 is fixed on a front end portion 48 of the lower frame 14 in an integrally rotatable manner. A mounting portion 24 and an integrally provided axis supporting portion 47 are arranged on a general middle portion of the generally horizontal portion of the lower frame and the axis X2 is mounted on the axis supporting portion 47. A shell and a cushion, not shown in drawings, are mounted on the seat frame 13 so as to be the seat 15. The seat frame 13 and the supporting body 7 are rotatably connected by the axis X1. The lower frame 14 and the seat frame 13 are rotatably connected by the axis X2. The supporting body 7 and the lower frame 14 are rotatably connected by the axis X3. In a front end portion of a side wall of the supporting body 7 arranged is a long hole 16 as a sliding guide that supports the axis X1 in a slidable manner back and forth. The axis X1 is urged toward a front end side of the long hole 16 by a reactive force mechanism 17 having an urging spring (for example, a compressive coil spring). The chair 11 in accordance with the embodiment comprises a reactive force adjusting mechanism 18 that adjusts a rocking hardness (a spring force of the reactive force mechanism 17). A code 19 is a member to change a sliding range of the axis X1. In accordance with the chair 11, when the lower frame 14 inclines rearward, a rear portion of the seat frame 13 is pulled rearward and at the same time the axis X1 makes a sliding movement rearward and rotates in the long hole 16. As a result of this, the urging spring of the reactive force mechanism 17 is compressed so as to obtain a reactive force. When an external force to incline the lower frame 14 rearward is released, the lower frame 14 is restored to its original position by a force from the urging spring of the reactive force mechanism 17.

In the chair 11 of this embodiment the backrest portion 1 is mounted as follows. More specifically, the frame body 9 as an upper portion of the back frame 2 is covered with the pocket 3 arranged at the upper half of the back face side of the backrest portion 1. The engaging plate 4 arranged at the opening edge portion 3*a* of the pocket 3 is mounted on the front face side of the cross beam 9*b* with pulling the engaging plate 4. The backrest portion 1 can be mounted on the back frame 2 with an appropriate tension given to the backrest portion 1 by mounting the engaging plate 4 with pulling the engaging plate 4. As a result of this, the superficial skin 8 and the pocket 3 can be prevented from being unstrained or wrinkling. Further, since the engaging plate 4 makes an engagement with the cross beam 9*b*, the appropriate tension is maintained and the upper portion of the back frame 2 can be prevented from being pulled out of the pocket 3. The lower end side of the backrest portion 1 is inserted into the groove 35 of the movable member 23. With the above procedure, the backrest portion 1 can be mounted on the chair 11.

Figure 9:
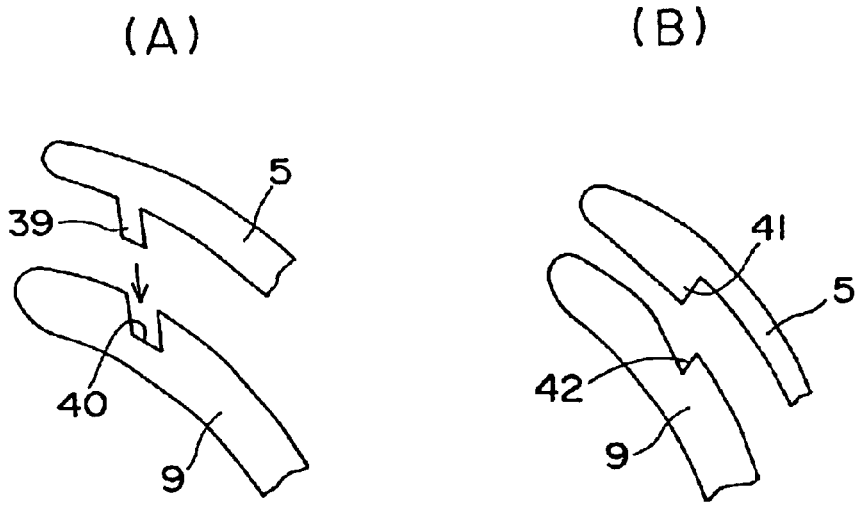
FIG. 9 is a general center cross-sectional side view showing a structure for connecting the backrest portion and the back frame, wherein a concave portion engages with a convex portion in (A) and a peak portion engages with a valley portion in (B).

In this embodiment, the back frame 2 is fixed to the backrest portion 1 with two screws 36 at positions, for example, near both ends of the cross beam 9*b* after the frame body 9 is covered with the pocket 3 in order to prevent the backrest portion 1 from being misaligned to the back frame 2. The inner shell 5 has a mount portion 37 protruding from the lower end portion of the backrest portion 1 and the groove 35 of the movable portion 23 is in such a shape that the mount portion 37 can be inserted thereinto. The lower end portion of the backrest portion 1 is inserted into the groove 35 of the movable member 23 and then the mount portion 37 is held by the movable member 23 with, for example, two screws 38 inserted from a lower face side of the movable member 23 so as to fix the backrest portion 1 to the movable member 23. Pins made of resin or the like may be used instead of the screws 36, 38. Two screws 38 are to certainly prevent the backrest portion 1 from being misaligned to the back frame 2, and may not be used depending on the circumstances. For example, overlapped portions of the backrest portion 1 and the back frame 2 (in this embodiment the inner shell 5 of the backrest portion 1 and the channel shaped portion 9*a* of the frame body 9 of the back frame 2 facing to the inner shell 5) may be in such a shape to engage each other so as to prevent the backrest portion 1 from being misaligned to the back frame 2. In this case, an embodiment of the engagement is not limited in particular and, for example, an concave portion 39 and a convex portion 40 each of which completely fits each other may be formed as shown in FIG. 9(A), or a peak portion 41 and a valley portion 42 each of which just hooks each other may be formed as shown in FIG. 9(B).

In accordance with the present claimed invention, it is possible to mount the backrest portion 1 on the back frame 2 easily without an outer shell and with a few or no screw. If a screw is used, strength of the screw is such a degree that the backrest portion 1 can be prevented from being misaligned to the back frame 2. Then a number of screws can be reduced compared with a conventional case, thereby to reduce a number of components and a number of processing. In addition, since the structure for mounting the backrest 1 in accordance with the present claimed invention is simple, the backrest portion 1 can be dismounted from the back frame 2 with ease if necessary. Further, since it is possible to cover the inner structure of the back frame 2 with the pocket 3, an appearance and a design of the chair 11 can be improved.

In addition, since the inner shell 5 overlaps with the frame body 9, strength as a backrest can be improved compared with a case in which a shell consists of the inner shell 5 alone or the frame body 9 alone.

Further, since the engaging portion 4 is provided at the opening edge portion 3*a* of the pocket 3, the pocket 3 is prevented from being rolled and from being unstrained or wrinkling. In addition, since an edge of the pocket 3 (for example, a portion where the engaging plate 4 is sewed) is concealed inside the pocket 3, an appearance can be improved.

Figure 10:
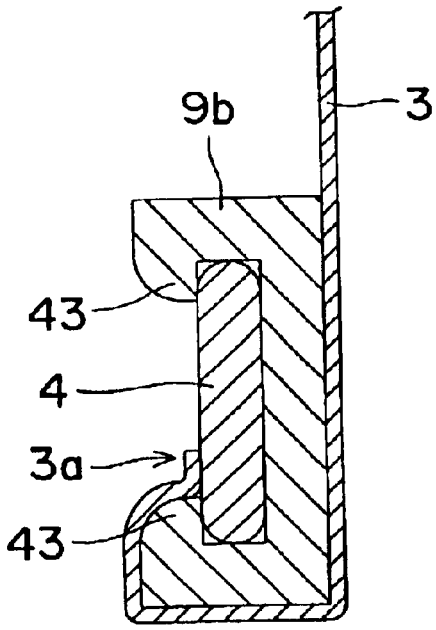
FIG. 10 is a general center cross-sectional side view showing another embodiment of an engaging state of an engaging portion.
Figure 11:
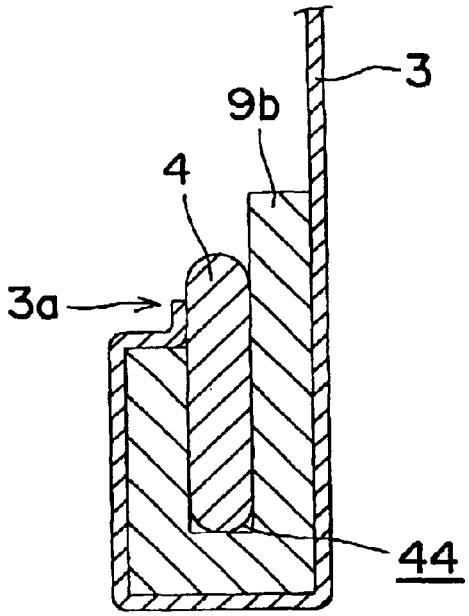
FIG. 11 is a general center cross-sectional side view showing a different embodiment of an engaging state of an engaging portion.
Figure 12:
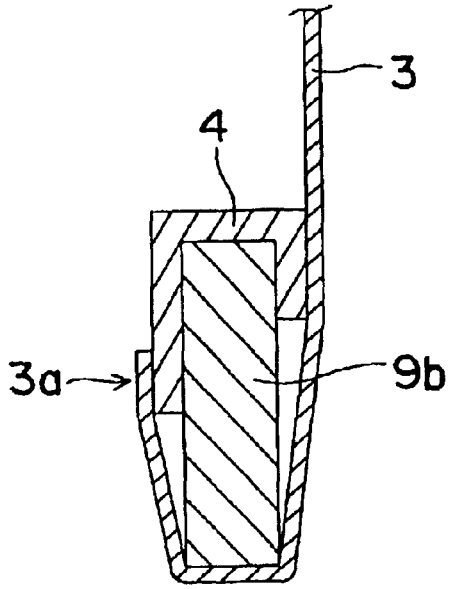
FIG. 12 is a general center cross-sectional side view showing a further different embodiment of an engaging state of an engaging portion.
Figure 13:
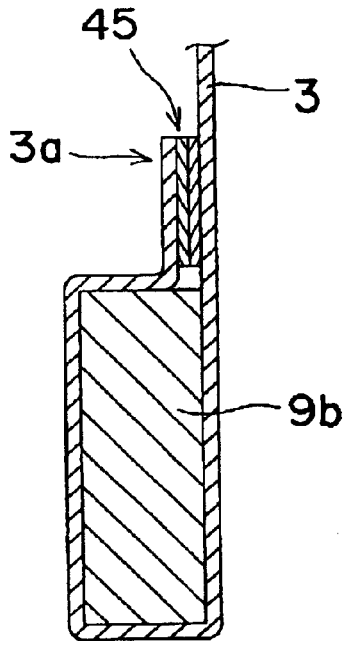
FIG. 13 is a general center cross-sectional side view showing a further different embodiment of an engaging state of an engaging portion.
Figure 14:
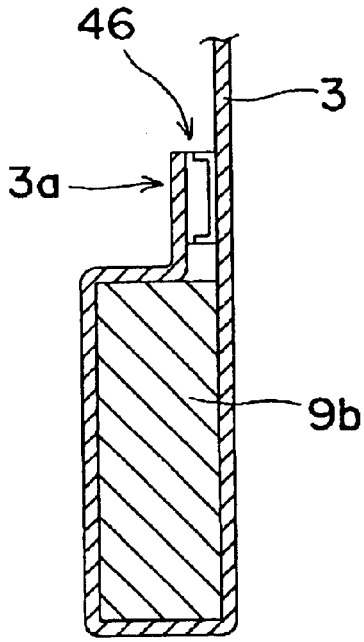
FIG. 14 is a general center cross-sectional side view showing a further different embodiment of an engaging state of an engaging portion.
Figure 15:
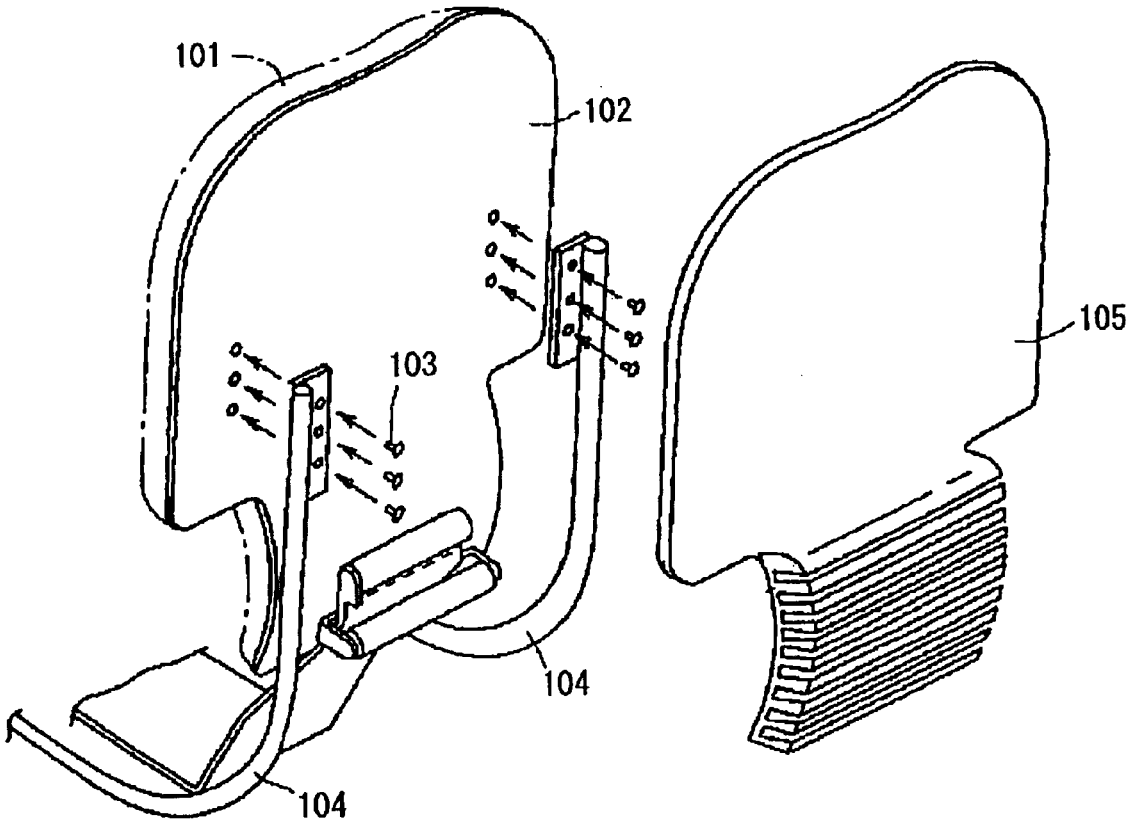
Fig. 15 PRIOR ART
FIG. 15 is a perspective view showing a conventional structure for mounting a backrest.

The above embodiment is one of preferable embodiments of the present claimed invention and the invention is not limited to this, and there may be various modifications without departing from a spirit of the present claimed invention. For example, a shape or a position to be mounted of the engaging portion 4 or a way to engage the engaging portion 4 with the back frame 2 is not limited to the above embodiment. The engaging portion 4 may be any shape or may be arranged at any position and the way to engage the engaging portion 4 may be any as far as the upper portion (the frame body 9 in the above embodiment) of the back frame 2 covered with the pocket 3 can be prevented from being pulled out of the pocket 3. Further, it is more preferable that tensile force is generated for the pocket 3 or the superficial skin 8 by engaging the engaging portion 4 with the upper portion of the back frame 2 and the engaged state is secured by the tensile force. For example as shown in FIG. 10, an engaging nail 43 may be provided on a front face side (a seated person's side) of the cross beam 9*b* to prevent the engaging plate 4 from being pulled out. In addition, for example as shown in FIG. 11, a deep groove 44 that opens upward may be formed on the cross beam 9*b* into which more than a half of the engaging plate 4 is inserted. Further, for example as shown in FIG. 12, the engaging portion 4 may be in a shape of a hook so as to hook on a plate-shaped cross beam 9*b*. For example as shown in FIG. 13, the engaging portion may consist of openable and closable tape 45 made of synthetic resin one of whose surface is hook-shaped and other is ring-shaped so as to form a pair (a velcro fastening (Trademarks)). In this case, the openable and closable tapes 45 are arranged, for example, at the opening edge portion 3*a* of the pocket 3 and a position facing to the opening edge portion 3*a* when the opening edge portion 3*a* is entangled with the cross beam 9*b*, the opening edge portion 3*a* is entangled with the cross beam 9*b* and then the opening edge portion 3*a* and the cross beam 9*b* are fixed with a pair of the openable and closable tapes 45. In addition, for example as shown in FIG. 14, a fitted button 46 may be used as the engaging portion one part of which fits into the other by being pressed. In this case, the fitted button 46 is arranged, for example, at the opening edge portion 3*a* of the pocket 3 and a position facing to the opening edge portion 3*a* when the opening edge portion 3*a* is entangled with the cross beam 9*b*, the opening edge portion 3*a* is entangled with the cross beam 9*b* and then the opening edge portion 3*a* and the cross beam 9*b* are fixed with the fitted button 46. Although not shown in drawings, the opening of the pocket 3 may be closed with the above-mentioned tapes 45 or the fitted button 46 so as to prevent the upper portion of the back frame 2 covered with the pocket 3 from being pulled out of the pocket 3.

As is clear from the above explanation, in accordance with the structure for mounting the backrest described in claim 1, since the upper portion of the back frame is covered with the pocket and the engaging portion makes an engagement with the covered upper portion so as to mount the backrest portion on the back frame, it is possible to mount the backrest portion on the back frame without an outer shell and with a few or no screw. If a screw is used, strength of the screw is such a degree that the backrest portion can be prevented from being misaligned to the back frame. Then a number of screws can be reduced compared with a conventional case, thereby to reduce a number of components and a number of processing. In addition, since the structure for mounting the backrest is simple, the backrest portion can be dismounted from the back frame with ease if necessary. Further, since it is possible to cover the inner structure of the back frame with the pocket, an appearance and a design of the chair can be improved.

Further, in accordance with the structure for mounting the backrest described in claim 2, the backrest portion can be supported in a stable condition by overlapping the inner shell and the frame body of the back frame.

Further, in accordance with the structure for mounting the backrest described in claim 3, since the engaging portion is provided at the opening edge portion of the pocket, the pocket is prevented from being rolled and from being unstrained or wrinkling.

Further, in accordance with the structure for mounting the backrest described in claim 4, a lumbar support mechanism that can adjust a protruding amount of the bent portion that is formed to protrude toward the lumbar of the seated person can be constructed.

What is claimed is:

1. A structure for mounting a backrest, wherein a chair comprises at least a backrest portion to support a back of a seated person and a back frame to connect the backrest portion with a seat, wherein the backrest portion has a pocket that covers an upper portion of the back frame, the pocket has an engaging portion that prevents the upper portion from being pulled out of the pocket by making an engagement with the upper portion of the back frame, the engagement portion being arranged at an opening edge portion of the pocket wherein the upper portion of the back frame has a cross beam located near the opening edge portion of the pocket when the upper portion of the back frame is covered with the pocket, wherein the upper portion of the back frame is covered with the pocket and the backrest portion is mounted on the back frame by engaging the engaging portion with the covered upper portion of the back frame by wrapping the opening edge portion of the pocket around at least a portion of the cross beam and interconnecting the opening edge of the pocket with the cross beam, and wherein the upper portion of the back frame is inclinable relative to a lower portion of the back frame.

2. A structure for mounting a backrest, wherein a chair comprises at least a backrest portion to support a back of a seated person and a back frame to connect the backrest portion with a seat, wherein the backrest portion has a pocket that covers an upper portion of the back frame, the pocket has an engaging portion that prevents the upper portion from being pulled out of the pocket by making an engagement with the upper portion of the back frame, the engaging portion being arranged at an opening edge portion of the pocket wherein the upper portion of the back frame has a cross beam located near the opening edge portion of the pocket when the upper portion of the back frame is covered with the pocket, wherein the upper portion of the back frame is covered with the pocket and the backrest portion is mounted on the back frame by engaging the engaging portion with the covered upper portion of the back frame by wrapping the opening edge portion of the pocket around at least a portion of the cross beam and interconnecting the opening edge of the pocket with the cross beam, and wherein the backrest portion comprises a frame-shaped inner shell and a bag-shaped superficial skin that wraps the inner shell and that the upper portion of the back frame has a frame body comprising a portion facing the inner shell and a portion that makes an engagement with the engaging portion.

3. The structure for mounting a backrest described in claim 1 wherein the backrest portion comprises a frame-shaped inner shell and a bag-shaped superficial skin that wraps the inner shell and that the upper portion of the back frame has a frame body comprising a portion facing to the inner shell and a portion that makes an engagement with the engaging portion.

4. A structure for mounting a backrest, wherein a chair comprises at least a backrest portion to support a back of a seated person and a back frame to connect the backrest portion with a seat, wherein the backrest portion has a pocket that covers an upper portion of the back frame, the pocket has an engaging portion that prevents the upper portion from being pulled out of the pocket by making an engagement with the upper portion of the back frame and the upper portion of the back frame is covered with the pocket and the backrest portion is mounted on the back frame by engaging the engaging portion with the covered upper portion of the back frame, wherein the backrest portion has a bent portion that is formed to protrude toward a lumbar of the seated person, the back frame has a movable member that is so arranged to move relatively to the back frame, a lower end side of the backrest portion is mounted on the movable member and a protruding amount of the bent portion can be adjusted by moving the movable member.

* * * * *